US005643402A

United States Patent [19]

Schmid

[11] Patent Number: 5,643,402

[45] Date of Patent: Jul. 1, 1997

[54] METHOD AND DEVICE FOR PRESSING INJECTION MATERIAL INTO THE JOINTS BETWEEN CONCRETE BODIES

[75] Inventor: Rene P. Schmid, Oberweningen, Switzerland

[73] Assignee: Rascor Spezialbau GmbH, Oberstenfeld-Stuttgart, Germany

[21] Appl. No.: 374,620

[22] PCT Filed: Jul. 8, 1993

[86] PCT No.: PCT/EP93/01788

§ 371 Date: Jan. 17, 1995

§ 102(e) Date: Jan. 17, 1995

[87] PCT Pub. No.: WO94/02694

PCT Pub. Date: Feb. 3, 1994

[30] Foreign Application Priority Data

Jul. 20, 1992 [DE] Germany ..... 42 23 844.7

[51] Int. Cl.[6] ..... E04F 21/165

[52] U.S. Cl. ..... 156/509; 156/502; 52/396.02; 52/503; 52/514.5; 52/576; 52/577; 52/731.2

[58] Field of Search ..... 156/502, 509; 52/503, 576, 577, 396.02, 731.2, 514.5

[56] References Cited

U.S. PATENT DOCUMENTS 5,249,401 10/1993 Schmid ..... 52/503
5,327,693 7/1994 Schmid ..... 52/396.02
5,377,469 1/1995 Schmid ..... 52/396.02

FOREIGN PATENT DOCUMENTS 0418699 3/1991 European Pat. Off. .
970368 6/1950 France .

*Primary Examiner*—James Sells
*Attorney, Agent, or Firm*—Jones & Askew, LLP

[57] ABSTRACT

The invention concerns a device for introducing sealing material into at least one tubular injection element (12, 13), such as a hose and/or channel, in a concrete joint-sealing system, the injection element joining forming a sealant-injection path in the interior of the concrete and being laid between a primary and a secondary concrete slab on the surface of the primary slab and surrounded by the secondary slab. On injection, sealant flows out of the injection element into the joints between the concrete slabs. The device consists of a target element (1) which is connected for sealant transfer with the injection element and forms a cavity in the secondary concrete slab. In comparison with the injection element, the cross-sectional dimensions of the target element (1) are considerably larger, the target element (1) acting as a target for a bore made from outside, after producing the secondary concrete slab, through the secondary slab into the target element (1), the sealant being introduced through the bore into the target element (1) and, from there, into this injection element (12, 13).

26 Claims, 2 Drawing Sheets

Figure 1:
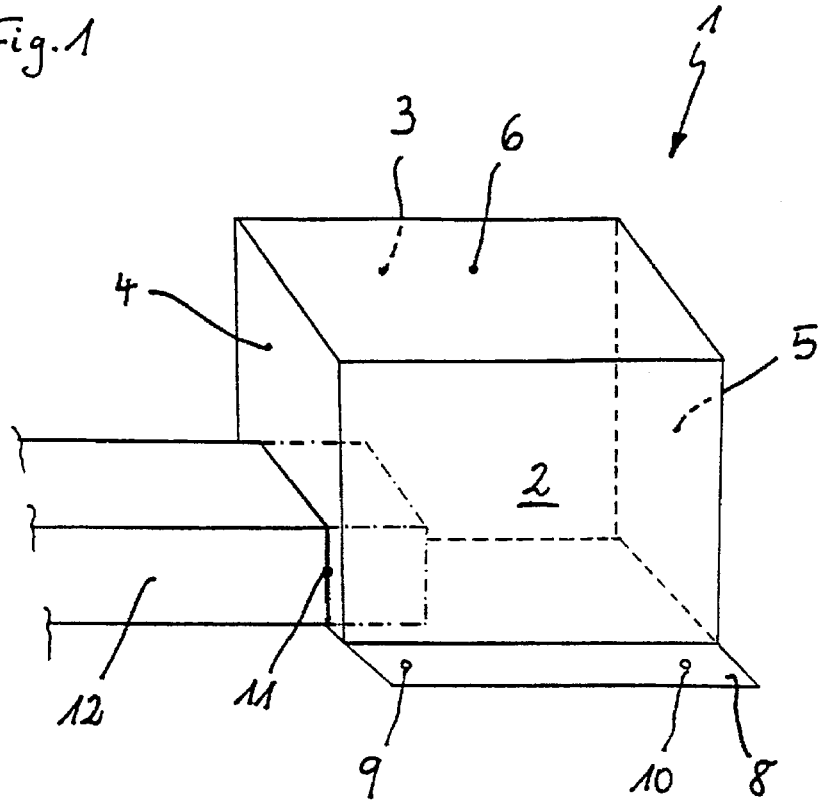

METHOD AND DEVICE FOR PRESSING INJECTION MATERIAL INTO THE JOINTS BETWEEN CONCRETE BODIES

The invention pertains to a method and a device for pressing injection material into the joints between concrete bodies as well as an arrangement of the device on a concrete surface of a primary concrete body.

It is known to utilize injection tubes (Swiss Patent No. 600,077) or injection channels (European Patent No. 0,418, 699 A1) in systems for sealing the joints between concrete bodies.

In instances in which injection tubes are used, the tube ends of an injection tube assigned to a grouting sector (joints between concrete bodies are usually divided into grouting sectors that have a length of approximately 8 to 12 m) extend toward the outside so that the beginning of the tube and the tube end are freely accessible from the outside after completing the concrete work within the region of the joint. The concrete boarding must be provided with corresponding openings for the ends of the injection tube, so that additional labor is required with respect to the concrete boarding. The injection material is pressed into one end of the tube until it is discharged at the other end of the tube. Subsequently, the grouting of the joints is carried out by increasing the pressure. During the erection of the concrete boarding and/or the grouting process, it is sometimes difficult to prevent the ends of the tube from being damaged, so that the introduction of the injection material becomes more difficult.

In order to press the injection material into the injection channels, the aforementioned state of the art suggests aligning the abutting edges of two opposing channels at a distance from one another and placing a press-in plug connection of identical dimensions over the region of the abutting edges in a positive fashion, whereby a movable, portative and non-porous tube extends from the outside of the concrete body into the interior of the press-in plug connection such that the injection material may be pressed in.

The aforementioned state of the art pertaining to injection channels additionally suggests producing a subsequent connection with the injection channel via a bore to be arranged in the concrete wall after completing the concrete work and disassembling the concrete boarding of the secondary concrete wall instead of providing tubes that extend toward the outside.

The invention is based on the objective of creating a method and a device for pressing injection material into the joints between concrete bodies that simplifies the process of pressing injection material into the joints between concrete bodies, in particular into the joints between concrete bodies that are provided with injection tubes and/or injection channels. In addition, an arrangement of this device on a concrete surface of a primary concrete body should be created that insures a simple and safe grouting of the joints between concrete bodies.

The hollow target body provided according to the invention is connected with the tubular injection body, e.g., an injection channel, which forms the subsequent injection path in such a way that the injection material introduced into the hollow target body is conveyed into the tubular body. This conveyance of the injection material into the tubular body may, for example, be realized by the fact that the tubular body protrudes with its open end into the hollow target body. Alternatively, two tubular bodies may protrude with their open ends into the hollow target body and be arranged therein at a distance from one another, so that the injection material may be conveyed from the target body into the tubular body via the open ends of said tubular body.

One essential aspect of the invention consists of the fact that the target body provides a relatively large target surface that serves as a perfect location for a bore that may be drilled into the concrete wall containing the hollow target body from the outside. For this, it suffices to mark the approximate location of the target body on the primary concrete wall before the secondary concrete wall is arranged over the tubular body and the hollow target body connected with it. When drilling the bore into the secondary concrete wall, the positioning of the drill on the wall is not very critical since the target body provides a relatively large target surface that cannot be missed when drilling the bore, so that an axis to the interior of the hollow target body and consequently to the injection channel or injection tube is realized and the pressing of injection material into the joints between concrete bodies is insured.

The hollow target body, which is provided according to the invention and connected with the tubular body in principle, may have any arbitrary shape as long as a sufficiently large target surface aligned with the wall is attained. In this, the width of the target body is not very critical. It is preferred if the target body at least has a width that corresponds with the tubular body connected with the target body so as to insure that the rear side of the target body is not penetrated when drilling the bore into the secondary wall. A generally cuboid shape is preferred for the target body.

Figure 2:
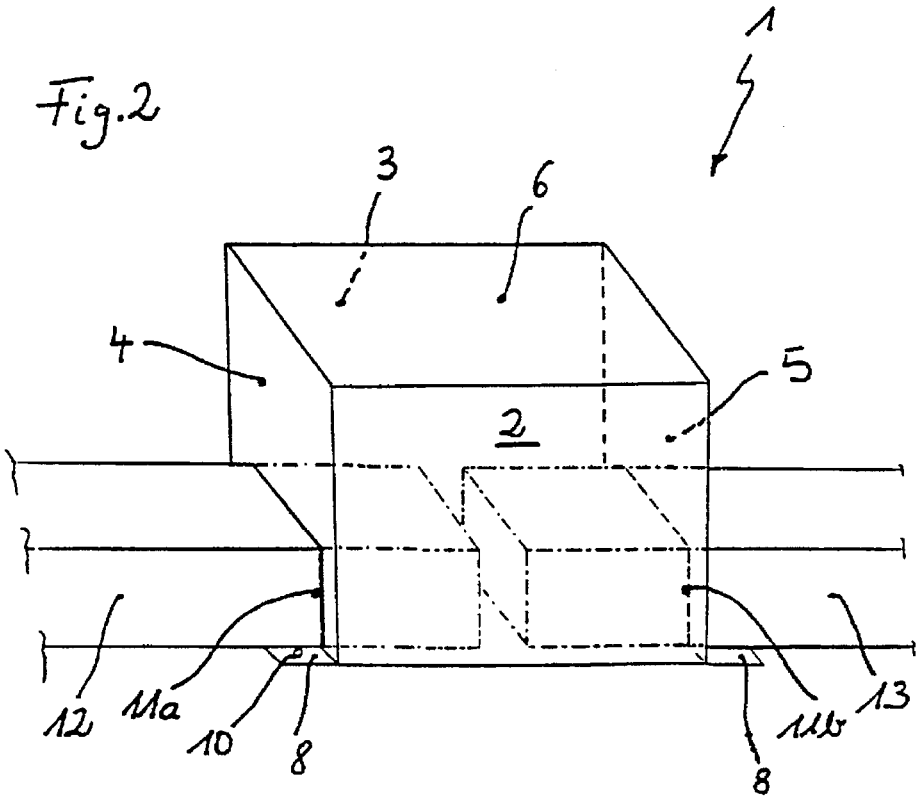
Figure 3:
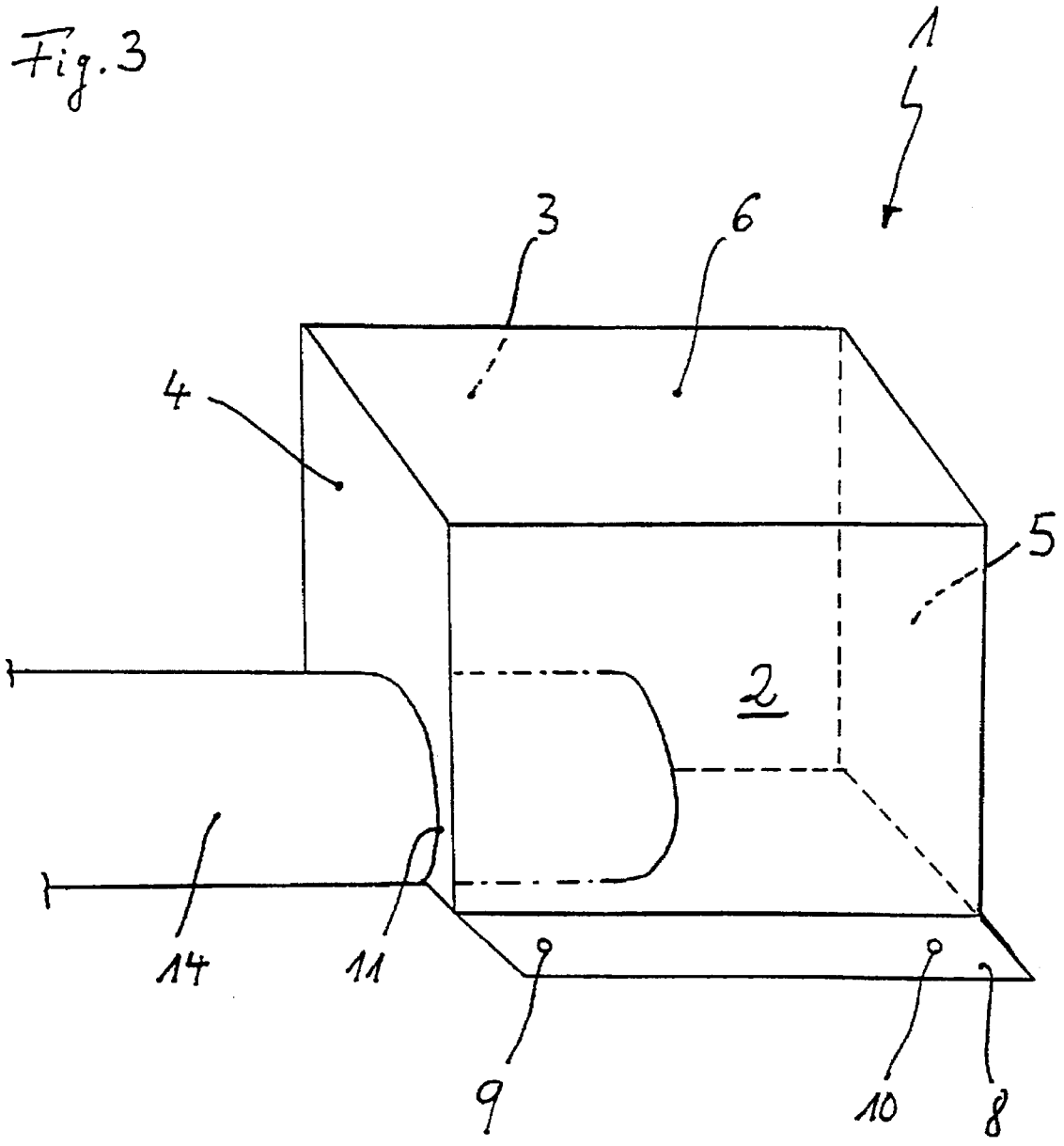

The invention is described in detail below with reference to the figures; the figures show:

FIG. 1: a first embodiment of the hollow target body of the device according to the invention in association with the end of one injection channel for introducing injection material;

FIG. 2: a second embodiment of the hollow target body of the device according to the invention in association with two tubular injection channels for introducing injection material; and FIG. 3: one additional embodiment of the hollow target body of the device according to the invention in association with only one individual injection tube.

The hollow target bodies 1 shown in FIGS. 1 and 2 have a cuboid shape. The cube 1 is designed in such a way that it has two large surfaces 2 and 3 situated opposite as well as parallel to one another, two small face surfaces 4 and 5 situated opposite as well as parallel to one another, and one top surface 6. The target body 1 is not provided with a base surface. Within the region of the base of the target body 1 are arranged fastening flanges 8 with at least one hole, preferably two holes 9 and 10, for the penetration of a fastening means, e.g., screws, on the lateral surfaces situated opposite one another. The flanges 8 in the embodiment of the target body 1 according to FIGS. 1 and 3 are arranged on the lower edges of the large lateral surfaces 2 and 3 of the cube, while the flanges in the target body according to FIG. 2 are arranged on the small face sides 4 and 5. The flanges 7 and 8 lie in the same plane and essentially extend parallel to the top surface 6 of the cube 1.

The hollow target body 1 shown in FIG. 1 has a rectangular opening 11 on the left face side 4, while the face side 5 situated on the opposite side is designed continuously without an opening. The contour of the opening 11 is adapted to the cross section of a rectangular, U-shaped injection channel 12, the open end of which extends into the hollow target body 6 by a predetermined distance.

The hollow target body 1 shown in FIG. 2 has rectangular openings within the region of the base on both face sides 4 and 5, namely openings 11*a* and 11*b*, the design of which corresponds with the target body in FIG. 1. These openings serve for accommodating two injection channels 12 and 13 inserted with their open ends into the target body 1 through the openings 11*a* and 11*b* in such a way that the ends of the injection channels situated in the interior are arranged at a distance from one another.

If used for pressing injection material into the joints between concrete bodies, the injection channels 12 and 13 or the only injection channel 12 (FIG. 1) initially is installed in a conventional fashion on the concrete surface of a primary concrete body, e.g., a floor. Subsequently, the hollow target body 1 is placed over the open ends of the injection channels with the corresponding openings 11 or 11*a* and 11*b*, attached onto the concrete surface of the primary concrete body and rigidly fastened thereon by a connecting means introduced into the concrete via the holes 9 and 10 in the fastening flange 8. Subsequently, the secondary concrete body, e.g., a wall on the primary concrete wall, is erected such that it encloses the injection channels and the hollow target body. The position of the hollow target body 1 may, if necessary, be marked roughly on the primary concrete body before the erection of the secondary concrete body. After the concrete work and the disassembly of the concrete boarding of the secondary concrete body, a bore is drilled into the target body 1 through the secondary concrete body while observing the marking on the primary concrete body. In this, one of the two large-surface walls 2 or 3 of the target body 1 insures that the target body 1 cannot be missed while drilling the bore. Consequently, the side walls 2 and 3 of the target body somewhat represent target surfaces. Subsequently, injection material is pressed into the target body 1 via the bore drilled into the secondary target body and exits into the target body 1. From there, the injection material is pressed into the tubular injection body 12 and 13 and penetrates into the flaws in the concrete via the open base side of the injection body while reliably filling said flaws with the injection material.

It is preferred if the hollow target body according to the invention as well as the injection channel or the injection tubes are manufactured of plastic which, in consideration of the fact that these components are only used once, represents a cost-efficient material.

A sealing agent may, if necessary, be arranged between the opening 11 and the corresponding injection channel or the openings 11*a* and 11*b* and the corresponding injection channel.

FIG. 3 shows a different variation of the arrangement shown in FIG. 1 with a hollow target body 1 that is provided with a circular opening 11 for the penetration of an injection tube 14 with a circular cross section. The remaining constructive details correspond with the arrangement shown in FIG. 1. When using the injection tube 14, the supply of injection material from the target body into this tubular body is also carried out via its open ends. Analogous to FIG. 2, it is also possible to insert two injection tubes into the hollow target body via two openings.

In summation, it can be determined that the invention creates a target device, a special arrangement of said target device on a primary concrete body as well as a method for pressing injection material into joints between concrete bodies which allows a bore to be drilled into the concrete wall after erecting the secondary concrete body on the primary second body in an uncomplicated and targeted fashion such that said concrete wall is reliably connected with the injection channels or injection tubes installed on the primary concrete wall.

What is claimed is:

1. Device for sealing joints between a primary and a secondary concrete body, comprising:

a) at least one injection conduit having certain cross-sectional dimensions and installed on a concrete surface of the primary concrete body, the injection conduit being surrounded by the secondary concrete body and forming the injection path for a sealing medium into the interior of the concrete body, whereby the sealing medium may be discharged into the joints between the concrete body when initiating the sealing device; and b) a target body (1) which communicates with the injection conduit and forms a hollow space inside the secondary concrete body, the target body having substantially larger dimensions compared to the cross-sectional dimensions of the injection conduit and serving as a target for a bore to be drilled into the target body (1) from the outside through the secondary concrete body after completing the concrete work on said secondary concrete body, whereby the sealing medium is introduced into the target body (1) via the aforementioned bore and introduced from the target body into the injection conduit.

2. Sealing device according to claim 1, characterized by the fact that the target body (1) has cross-sectional dimensions that are at least twice as large, preferably three times as large, as those of the injection body (12,13,14).

3. Sealing device according to claim 1, characterized by the fact that the injection body (12,13,14) and the target body (1) are constructed as two separate components.

4. Sealing device according to claim 1, characterized by the fact that the target body (1) has a target surface that essentially extends parallel to the surface of the primary concrete body.

5. Sealing device according to claim 1, characterized by the fact that the target body (1) has a target surface that essentially extends perpendicular to the surface of the primary concrete body.

6. Sealing device according to claim 1, characterized by the fact that the target body (1) consists of plastic.

7. Sealing device according to claim 1, characterized by the fact that the target body (1) is essentially constructed in a cuboid fashion.

8. Sealing device according to claim 1, characterized by the fact that the target body (1) comprises at least one fastening flange (8) on the side of the concrete surface in order to be fastened to the primary concrete body.

9. Sealing device according to claim 8, characterized by the fact that the fastening flange (8) comprises at least one hole (9,10) for the passage of a fastening element into the primary concrete body, if necessary into a plug inserted in a bore in said primary concrete body, in particular, in the form of a screw, a pin, or a nail.

10. Sealing device according to claim 1, characterized by the fact that the target body (1) is open on the side of the concrete surface.

11. Sealing device according to claim 1, characterized by the fact that the target body (1) comprises a connecting element for the tubular injection body (12,13,14) on at least one face side that is situated perpendicular to the target surface (2,3).

12. Sealing device according to claim 11, characterized by the fact that the connecting element is an opening (11,11*a*, 11*b*) in the face side (4,5) of the target body, which is adapted to the cross-sectional contour of the tubular injection body (12,13,14).

13. Sealing device according to claim 11, characterized by the fact that the connecting element is a connecting sleeve that is constructed in one piece with the target body (1).

14. Sealing device according to claim 13, characterized by the fact that the connecting sleeve is constructed in such a way that it tapers toward its free end, in particular, in a gradual fashion.

15. Sealing device according to claim 1 on a concrete surface of a primary concrete body, characterized by the fact that the tubular injection body (12,13,14) and the target body (1) are arranged on the concrete surface of the primary concrete body.

16. Sealing device according to claim 15, characterized by the fact that the tubular injection body (12,13,14) is directly connected with the target body.

17. Sealing device according to claim 16, characterized by the fact that the tubular injection body (12,13,14) protrudes with one open end into the target body (1) by a certain distance.

18. Sealing device according to claim 16, characterized by the fact that the tubular injection body (12,13,14) is connected with the target body (1) in a sealed fashion.

19. Sealing device according to claim 15, characterized by the fact that the tubular injection body (12,13,14) and the target body (1) are constructed as one unit.

20. Sealing device according to claim 15, characterized by the fact that the tubular injection body (12,13,14) is connected with the target body (1) via a connecting element.

21. Sealing device according to claim 15, characterized by the fact that the target body (1) is arranged adjacent to the tubular injection body (12,13,14).

22. Sealing device according to claim 15, characterized by the fact that the target body (1) is connected with at least two tubular injection bodies (12,13).

23. Sealing device according to claim 15, characterized by the fact that the position of the target body (1) on the surface of the primary concrete body is marked in such a way that the marking is also visible after erecting the secondary concrete wall on the primary concrete wall such that it encloses the target body (1) and the injection body (12,13, 14).

24. Sealing device according to claim 15, characterized by the fact that the tubular injection body is a generally known (European Patent No. 0,418,699 A1) injection channel (12, 13).

25. Sealing device according to claim 15, characterized by the fact that the tubular injection body is an injection tube (14).

26. Sealing device for pressing injection material into joints between a primary concrete body and a secondary concrete body by utilizing the device according to claim 1, characterized by the fact that the tubular injection body and the target body are installed on the surface of the primary concrete body, that the secondary concrete body is erected on the primary concrete body such that it encloses the injection body and the target body, that a bore, which exits into the target body, is drilled into the secondary concrete body, and that the sealing medium is introduced into the target body via the bore and from the target body into the injection body.

* * * * *